US007697247B2

(12) United States Patent
Maharsi et al.

(10) Patent No.: US 7,697,247 B2
(45) Date of Patent: Apr. 13, 2010

(54) ARC SUPPRESSION CIRCUIT USING A SEMI-CONDUCTOR SWITCH

(75) Inventors: Mohamed Maharsi, Raleigh, NC (US); Douglas A. Voda, Sanford, FL (US); Mark C. Glacobbe, Coplay, PA (US); Dela Salah-Eldin Sayoumi, Center Valley, PA (US); Douglas A. Wood, Boyertown, PA (US)

(73) Assignee: ABB Technology AG, Zurich (CH)

( * ) Notice: Subject to any disclaimer, the term of this patent is extended or adjusted under 35 U.S.C. 154(b) by 169 days.

(21) Appl. No.: 11/598,240

(22) Filed: Nov. 10, 2006

(65) Prior Publication Data

US 2008/0112097 A1 May 15, 2008

(51) Int. Cl.
*H01H 9/30* (2006.01)

(52) U.S. Cl. ..... 361/8; 361/2; 361/3; 361/13

(58) Field of Classification Search ..... 361/1–8, 361/13

See application file for complete search history.

(56) References Cited

U.S. PATENT DOCUMENTS 4,636,907 A * 1/1987 Howell ..... 361/13
5,055,962 A * 10/1991 Peterson et al. ..... 361/187
5,604,656 A * 2/1997 Derrick et al. ..... 361/187
5,703,743 A * 12/1997 Lee ..... 361/6
6,621,668 B1 * 9/2003 Sare ..... 361/13
7,145,758 B2 * 12/2006 King et al. ..... 361/3

* cited by examiner

*Primary Examiner*—Stephen W Jackson
*Assistant Examiner*—Nicholas Ieva
(74) *Attorney, Agent, or Firm*—Paul R. Katterle; Lee Patent Services

(57) ABSTRACT

An arc suppression circuit in a protection relay having trip contacts is used to turn off a battery-powered solenoid and trip an AC power circuit breaker. The arc suppression circuit uses a switch-control circuit to control the turning off of a semi-conductor switch so that the semi-conductor switch provides a current path around the trip contacts, and is carrying all, or substantially all, of the load current, before the trip contacts are opened. When the trip contacts begin to open, the switch-control circuit holds the semi-conductor switch on for a sufficient time to prevent an arc from becoming established before turning the semi-conductor switch off. In a second embodiment, the arc suppression circuit provides a second switch-control circuit. This second switch-control circuit is configured to accept control signals from a microprocessor within a protection relay. The microprocessor turns the semi-conductor switch on before the contacts begin to open, thereby providing a current path around the contacts before the contacts begin to open. The microprocessor turns the semi-conductor switch off after a time sufficient to prevent an arc from becoming established.

9 Claims, 7 Drawing Sheets

ARC SUPPRESSION CIRCUIT USING A SEMI-CONDUCTOR SWITCH

TECHNICAL FIELD

This invention relates generally to circuits in AC power distribution switching systems used to control AC power circuit breakers. More specifically the invention relates to arc suppression circuits for protecting trip contacts that may be used to switch off an inductive DC current load such as the inductive load presented by the "opening solenoid" associated with an AC power circuit breaker.

BACKGROUND

Arcing is a well known problem in AC power switching. Arcing is the creation of an electrical arc between the contacts as they begin to open from a closed position. If, as the contacts open, the voltage across the contacts reaches a sufficient level, an arc will form between the contacts. Furthermore, if an arc does form, the arc may continue even after the contacts are well open. Arcing is well known to be undesirable because of the wear that arcing inflicts on the contacts, and because of undesirable circuit effects caused by arcing.

Protection relays contain circuits with mechanical trip contacts for switching-on and switching off AC power circuit breakers. The mechanical contacts are coupled to switch-on and switch off an "opening solenoid" that is mounted to the circuit breaker. These mechanical contacts are subjected to an inductive DC current load, the load presented by the "opening solenoid" of an AC power circuit breaker. So the contacts of the arc suppression circuits themselves need protection from wear caused by arcing. Increasingly, arc suppression circuits are being used to protect such mechanical contacts. The arc suppression circuits are typically mounted in a protection relay, and are located proximate to the mechanical contacts that they are to protect.

U.S. Pat. Nos. 5,703,743 and 5,652,688 disclose such arc suppression circuits. These patents disclose circuits having a normally-off power transistor with particular operating characteristics. The increase in the voltage across the trip contacts as the contacts open is used as an activating signal to turn on the normally-off power transistor, momentarily shunting the load current around the contacts during the time the contacts are opening.

SUMMARY OF INVENTION

The present invention provides an arc suppression circuit for suppression of arcing across trip contacts that may be used to turn off a battery-powered solenoid and trip an AC power circuit breaker. The arc suppression circuit of the present invention uses a switch-control circuit to control the turning off of a semi-conductor switch so that the semi-conductor switch provides a current path around the contacts, and is carrying all, or substantially all, of the load current, before the contacts are opened. When the contacts begin to open, the switch-control circuit holds the semi-conductor switch on for a sufficient time to prevent an arc from becoming established before turning the semi-conductor switch off.

The trip contacts that are protected by the present invention are those that are used to switch-on and switch off an inductive DC current load, such as the load presented by the "opening solenoid" of an AC power circuit breaker.

In a first preferred embodiment, the arc suppression circuit includes trip contacts that are coupled to operate a battery-powered solenoid. The semi-conductor switch is an insulated gate bipolar junction transistor (IGBT) connected across the battery-powered solenoid of an AC power circuit breaker and coupled to a switch-control circuit for turning on and turning off the semi-conductor switch.

The switch-control circuit is configured such that the semi-conductor switch is already on, providing a current path around the contacts, when the contacts begin to open, and such that the semi-conductor switch remains on and continues to provide a current path around the contacts for a sufficient time after the contacts begin to open to prevent an arc from becoming established In a first preferred embodiment, the semi-conductor switch is an insulated gate bipolar junction transistor (IGBT), i.e. a power transistor having a gate, and the switch-control circuit includes a capacitor connected in series with the contacts and the battery-powered solenoid, and a voltage divider connected across the capacitor, the voltage divider having an output coupled to the gate. Preferably, the switch-control circuit also includes a clamping diode coupled to the gate.

In a second embodiment, the circuit provides a second switch-control circuit. This second switch-control circuit is configured to accept control signals from a microprocessor within a protection relay. The microprocessor turns the semi-conductor switch on before the contacts begin to open, thereby providing a current path around the contacts before the contacts begin to open, and turns the switch off after a time sufficient to prevent an arc from becoming established.

DETAILED DESCRIPTION

1) First Preferred Embodiment of the Invention

Figure 1:
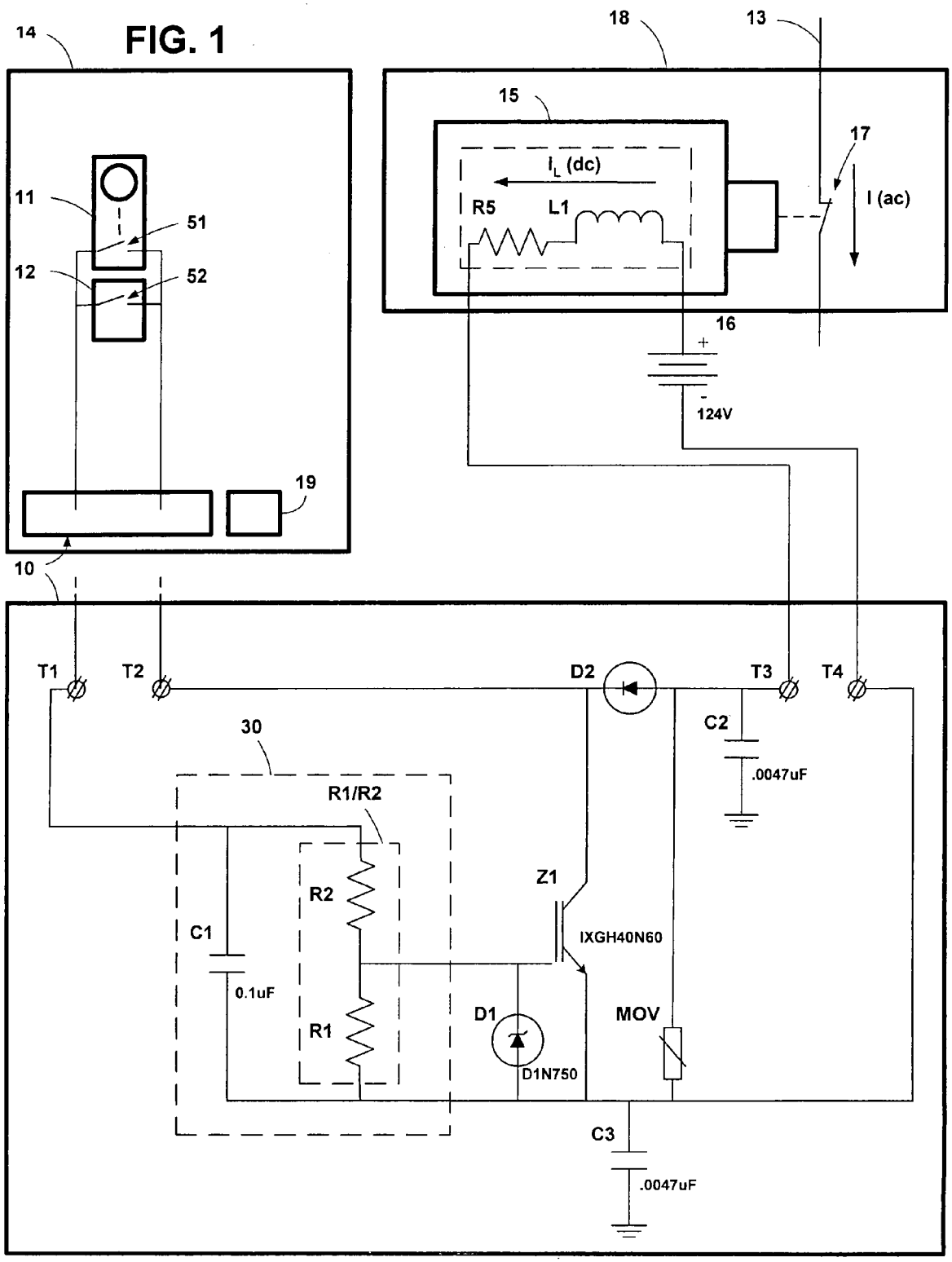
FIG. 1 is a schematic diagram showing a first preferred embodiment of the arc suppression circuit of the invention in context of an AC circuit breaker system having a circuit breaker and a protection relay.
Figure 2:
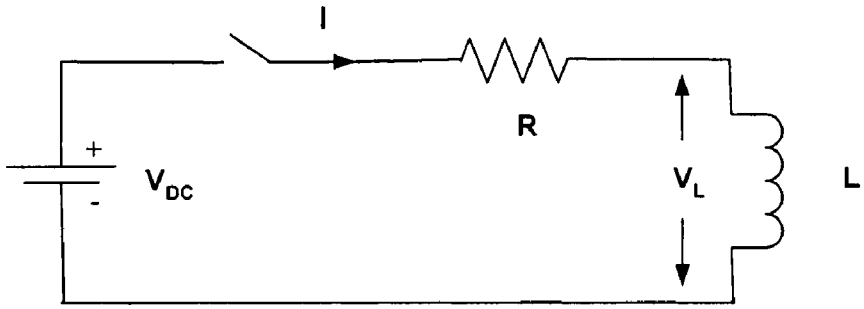
FIG. 2 is a circuit diagram for discussion of arcing in a circuit following the switching off of an inductive load subjected to a DC current.
Figure 3:
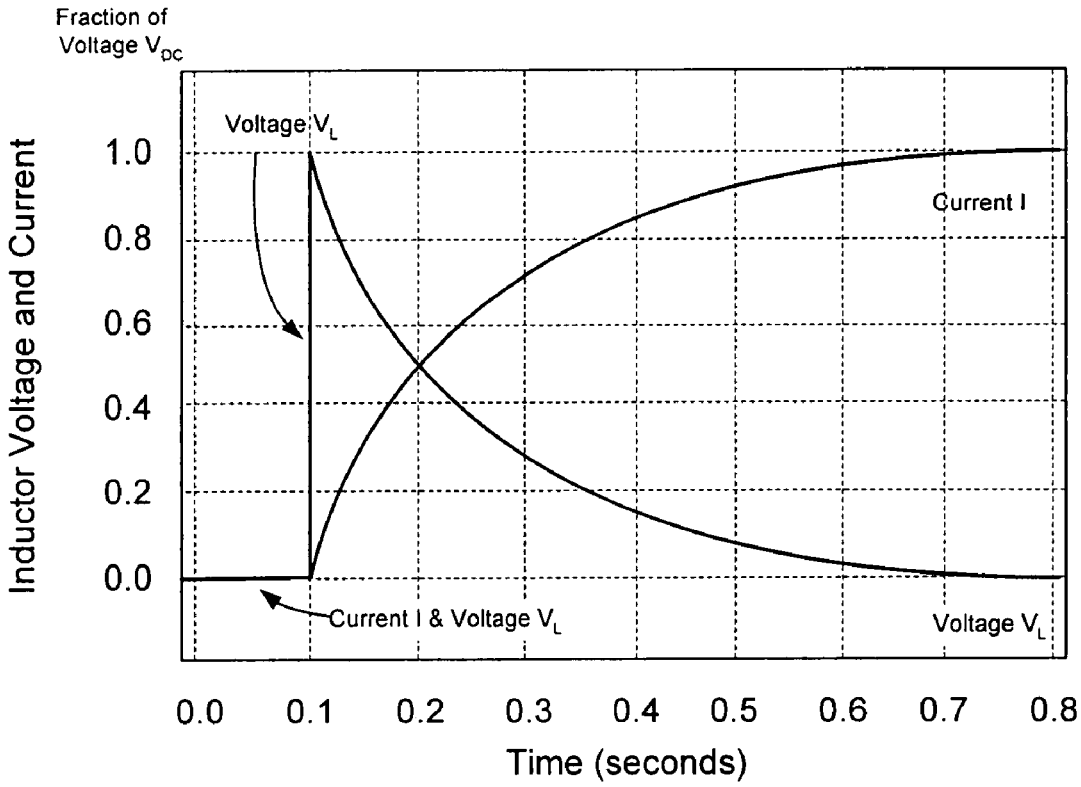
FIG. 3 is a graph showing current build-up in an inductor circuit.
Figure 4:
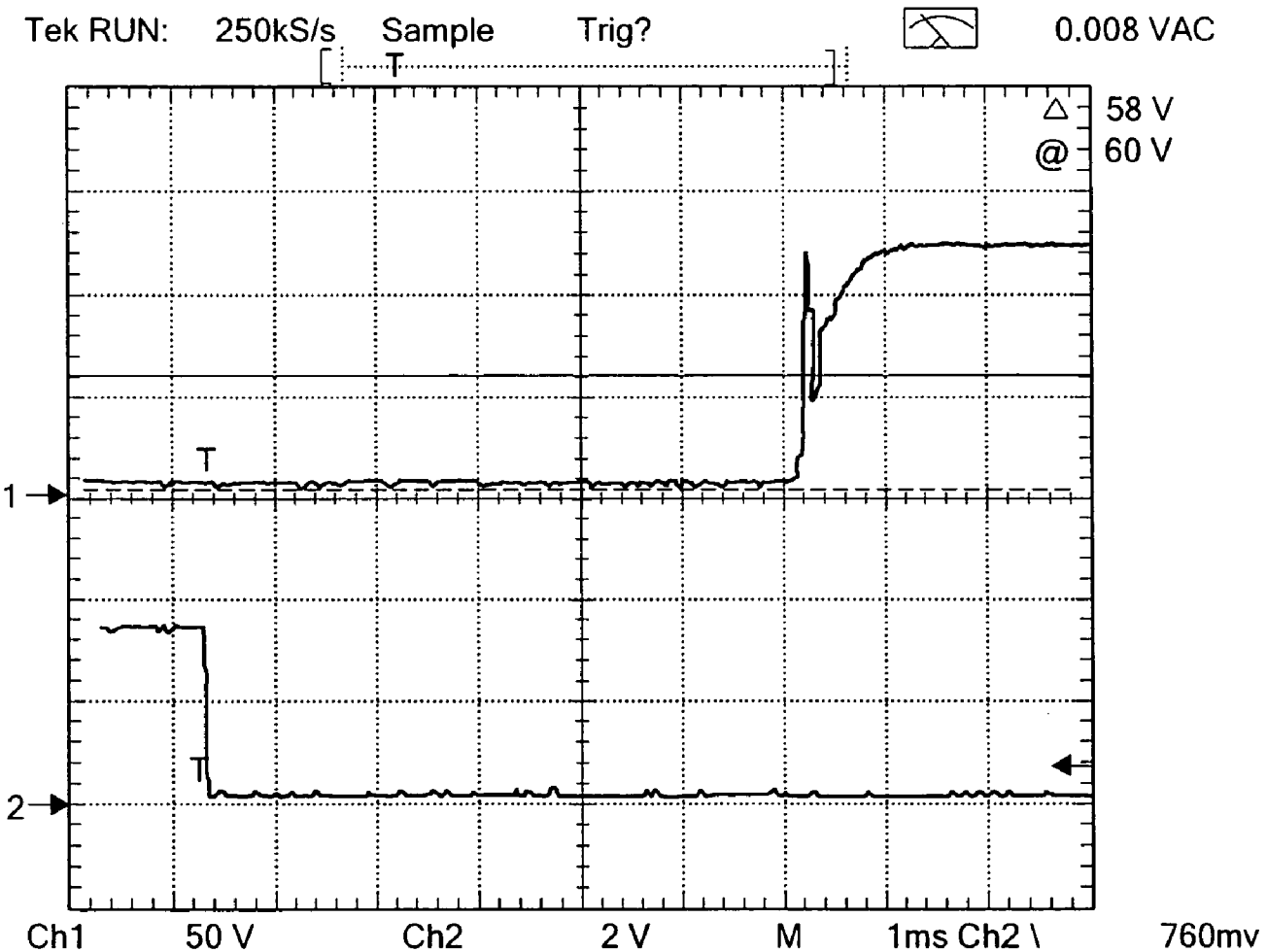
FIG. 4 is an oscilloscope trace showing a simulated transient electrical voltage associated with the first preferred embodiment.

FIG. 1 shows a first preferred embodiment of an arc suppression circuit for suppression of arcing across contacts used to switch off the DC current holding on the "opening solenoid" of an AC power circuit breaker.

The solenoid associated with an AC power circuit breaker is usually referred to an "opening solenoid". However, the "opening solenoid" associated with AC circuit breaker 18 in FIGS. 1, 5 and 8 herein, and with arc suppression circuits 10 and 40 in FIGS. 1 and 5, will be referred to, in the description that follows, as "solenoid 15" for clarity of description.

Solenoid 15 imposes on the trip contacts an inductive load subjected to a DC current. The trip contacts may include contacts in a protection relay used to control a circuit-breaker directly (manual operation), used to control a circuit-breaker indirectly (automatic operation), or both.

In the first preferred embodiment, a normally-on power transistor connected across the trip contacts shunts load current around the contacts while the contacts are closed and for a short period of time while the contacts are opening.

When the contacts first begin to open, the transistor continues to shunt load current around the contacts. Then after a predetermined time delay, the transistor is switched off completely. The predetermined time delay is long enough to ensure that the contacts are separated by a sufficient distance to prevent arcing.

In this way, the trip contacts are protected from damage by arcing by having the transistor continue to shunt load current around the contacts while the contacts are opening, and by having the transistor switch off completely after a predetermined time delay.

FIG. 1 shows arc suppression circuit 10 of a first preferred embodiment.

Circuit 10 is shown in FIG. 1 as a printed circuit board located in protection relay 14. Protection relay 14 also includes manual trip switch 11 and automatic trip switch 12. Manual trip switch 11 and automatic trip switch 12 include contacts 51 and 52, respectively. Both of contacts 51 and 52 are connected in parallel across terminals $T_1$ and $T_2$ of circuit 10. Contacts 51 and 52 are the contacts that circuit 10 is designed to protect.

Figure 8:
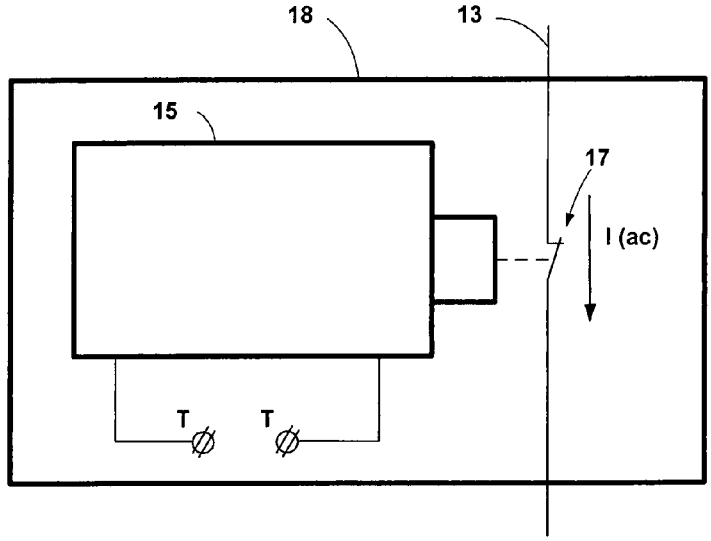
FIG. 8 (PRIOR ART)
FIG. 8 (prior art) is a schematic diagram showing an AC power line with an AC circuit breaker and its associated "opening solenoid".

FIG. 8 (prior art) shows a conventional "opening solenoid" (solenoid 15) coupled to trip an associated AC circuit breaker 18 in AC power line 13 by opening break contacts 17.

Figure 9:
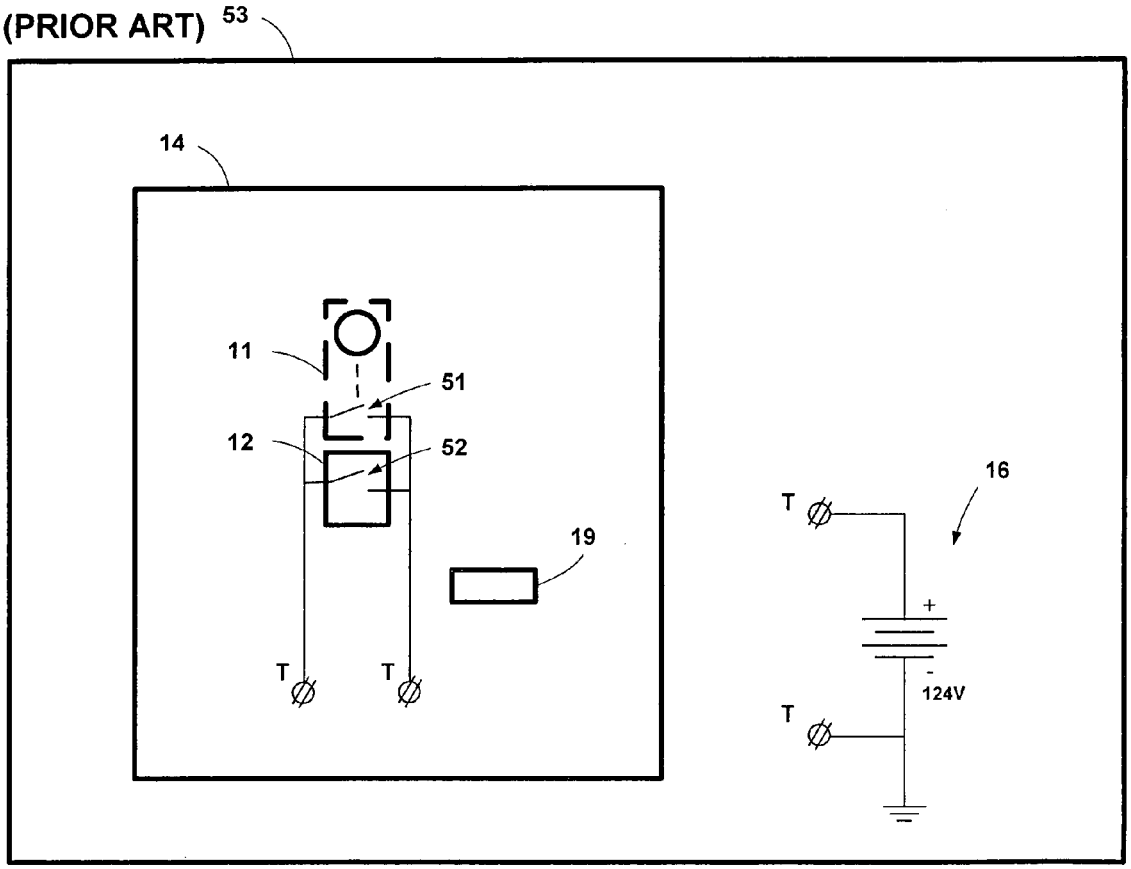
FIG. 9 (PRIOR ART)
FIG. 9 (prior art) is a schematic diagram showing a power distribution substation with a substation battery, and a protection relay having manual and automatic trip switches and an associated microprocessor.

FIG. 9 (prior art) shows a conventional electrical AC substation 53 containing a protection relay 14 and a substation battery 16. Battery 16 powers protection relay 14, and solenoid 15 in AC circuit breaker 18. The protection relay and the trip switches are normally located inside a building, while the AC circuit breaker is normally located outside the building, sometimes up on a pole.

Referring again to FIG. 1, solenoid 15 is represented by inductance L1 and resistance R5 for consideration of its effect as an electrical component when coupled to circuit 10 via battery 16 and terminals T3 and T4. Solenoid 15 and battery 16, connected in series as shown in FIG. 1, constitute a battery-powered solenoid.

This battery-powered solenoid is connected directly at terminals T3 and T4 to circuit 10. This battery-powered solenoid is also connected indirectly (via circuit 10) to manual trip switch 11 and automatic trip switch 12. Three switches, power transistor switch $Z_1$ of circuit 10, manual trip switch 11, and automatic trip switch 12, are essentially connected across the battery-powered solenoid. So any of them is capable of switching on solenoid 15, and any of them is capable of switching off solenoid 15 provided the other two switches are open.

Solenoid 15 is normally on, holding breaker contacts 17 closed. Switching off solenoid 15 opens breaker contacts 17.

Circuit 10 provides suppression of arcing across contacts 51 and 52 of trip switches 11 and 12 using a normally-on power transistor switch $Z_1$ connected across contacts 51 and 52. In continuous operation, when either of contacts 51 and 52 is closed, capacitor C1 is fully charged and transistor switch $Z_1$ is on, carrying substantially all the load current. From this condition, when the contacts open, capacitor C1 starts discharging, and the output of voltage divider R1/R2 falls. (The output of voltage divider R1/R2 is the voltage across R1).

The output of the voltage divider is applied to the gate of switch Z1. So as capacitor C1 discharges, the output of the voltage divider falls, and the voltage at the gate of Z1 falls. When the voltage at the gate of Z1 falls below the switch-off level of $Z_1$, $Z_1$ will cease to conduct. The time it takes for C1 to discharge is controlled by the values of C1, R1 and R2. Values for capacitor C1, and resistors R1 and R2 are selected to insure that both of contacts 51 and 52 are completely open before the gate voltage falls below the switch-off level of $Z_1$. This ensures that both contacts are sufficiently separated to prevent arcing before load current is switched off completely.

Capacitor C1 and voltage divider R1/R2, connected in parallel constitute switch-control circuit 30 which defines a resistance/capacitance time constant. The time constant of switch-control circuit 30 determines the value of the above-mentioned predetermined time delay. The predetermined time delay is selected to be long enough to ensure that the contacts are separated by a sufficient distance to prevent arcing.

AC circuit breaker contacts 17 are closed and opened as follows.

1a) Closing the AC Circuit Breaker Contacts

Closing either of trip contacts 51 and 52 initiates the closing of AC circuit breaker contacts 17 by switching off solenoid 15.

When either of trip contacts 51 and 52 closes, capacitor C1 charges, and resistors R2 and R1 form a voltage divider. When the gate of switch Z1 reaches approximately 10V, switch Z1 will conduct current through diode D2 and solenoid 15, and the current through solenoid 15 switches the solenoid on, causing AC circuit breaker contacts 17 to close. From this time on, during normal operation with circuit breaker contacts closed, transistor switch $Z_1$ is on, carrying substantially all the load current.

1b) Opening the AC Circuit Breaker Contacts

Prior to opening the second of trip contacts 51 and 52 (i.e. while at least one of them is closed), DC load current is flowing through solenoid 15, and substantially all of the DC load current is flowing through switch Z1, and solenoid 15 is holding AC circuit breaker contacts 17 closed.

When both of trip contacts 51 and 52 become open, capacitor C1 will slowly discharge through resistor R2 and R1. While capacitor C1 is discharging, switch Z1 will continue to conduct current, and solenoid 15, continuing to conduct current, will continue to hold AC circuit breaker contacts 17 closed.

While the gate voltage of switch Z1 is falling below approximately 10V, Z1 is slowly turning off, progressively limiting the current flowing through D2 and L1.

When the gate voltage of switch Z1 falls below the clamping voltage of diode D1, approximately 8 to 9 volts, diode D1 will no longer conduct.

After a predetermined delay defined by the values of C1, R1 and R2, the voltage at the gate of Z1 will fall below the gate threshold of Z1. When this happens, Z1 turns off completely, thereby preventing current from flowing through diode D2 and solenoid 15.

During the first part of an automatic trip sequence, trip contacts 52 are opening and the voltage at the gate of Z1 is falling. By the time the voltage at the gate of Z1 first falls below the gate threshold of Z1, trip contacts 52 will be separated by a sufficient distance to prevent arcing. It takes approximately 20-30 milliseconds for trip contacts 51 and 52 to be separated by a sufficient distance to prevent arcing. During a manual trip sequence, these same events occur, involving trip contacts 51.

1c) Circuit Protection Components

Diode D1 clamps the voltage across R1, the voltage applied to the gate of Z1, to approximately 10V, a voltage just above the gate threshold of Z1, for protection Z1 from overvoltage applied at its gate.

Diode D2 is provided for reverse polarity protection of circuit 10, including protection of circuit 10 in the event a replacement battery is installed the wrong way round.

Metal oxide varistor MOV is provided to protect Z1 from being damaged by overvoltage applied across its current-carrying terminals.

2) Second Embodiment of the Invention

Figure 5:
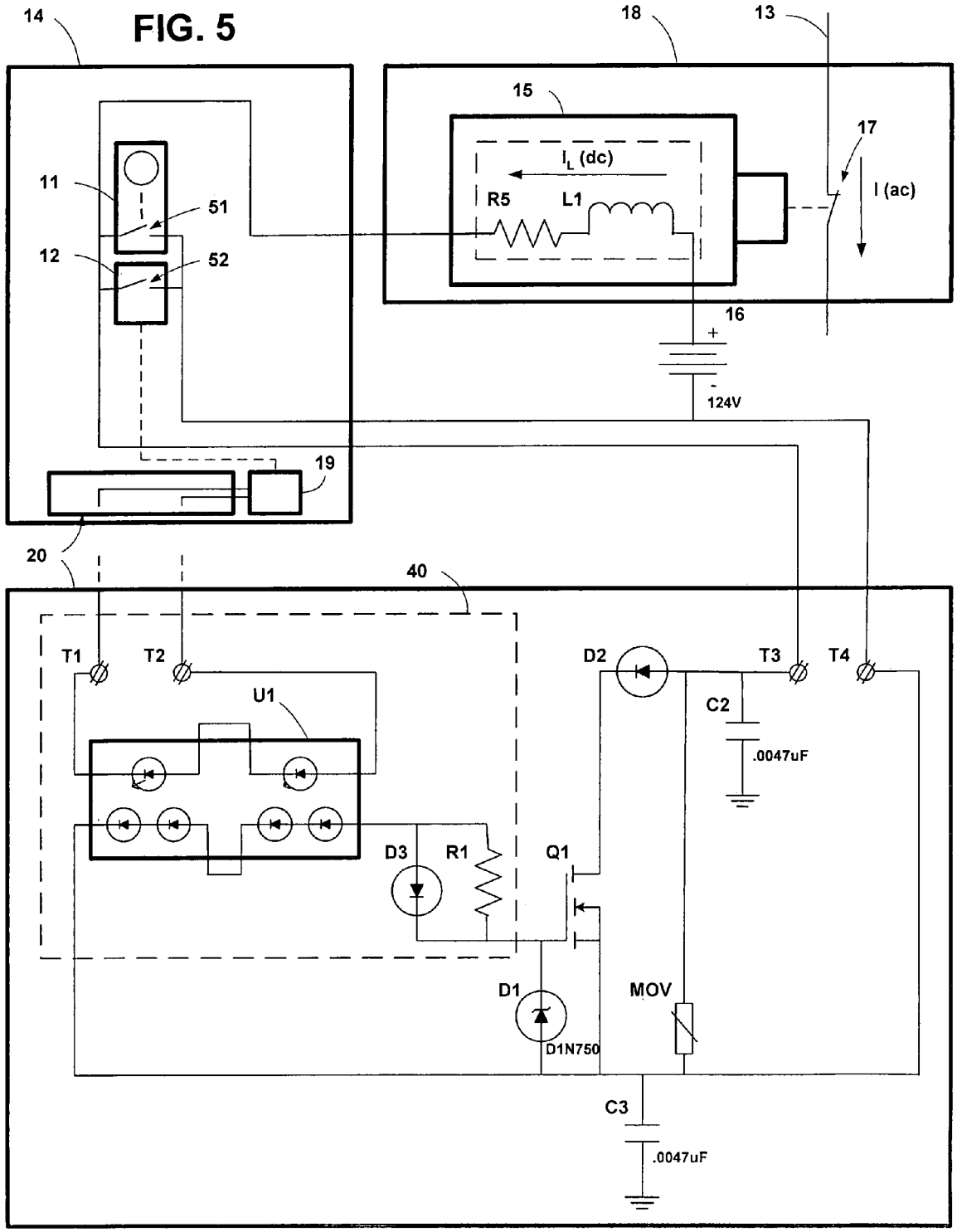
FIG. 5 is a schematic diagram showing a second embodiment of the arc suppression circuit of the invention in context of the AC circuit breaker system of FIG. 1.

FIG. 5 is a circuit diagram showing a second embodiment of the arc suppression circuit of the present invention.

In this second embodiment, the arc suppression circuit provides a semi-conductor switch configured to accept control signals from a microprocessor within the protection relay. The microprocessor controls the timing of the switching on of the semi-conductor switch. The microprocessor turns the switch on before the contacts begin to open, thereby providing a current path around the contacts before the contacts begin to open. The semi-conductor switch is turned off after a predetermined time, a time sufficient to prevent an arc from becoming established. In a preferred mode, the predefined time is determined by the microprocessor. In an alternative mode, the predefined time is determined by the time constant of a resistance and the parasitic capacitance of the semi-conductor switch.

Referring to FIG. 5, arc suppression circuit 20 provides semi-conductor switch Q1 connected across battery-powered solenoid 15, and a switch-control circuit 40 for controlling switch Q1. The switch-control circuit is configured to accept control signals from microprocessor 19 within protection relay 14 such that switch Z1 is turned on, thereby providing a current path around contacts 51 and 52, before the contacts begin to open.

Arc suppression circuit 20 includes switch-control circuit 40 for controlling semi-conductor switch, and photo-voltaic isolator U1.

Isolator U1 is adapted to transmit control signals received from microprocessor 19 within protection relay 14 to switch-control circuit 40.

For automatic operation, switch-control circuit 40 is adapted to receive the control signals, and to transmit corresponding control signals to arc suppression circuit 20 to turn switch Q1 on before microprocessor 19 commands contacts 52 of automatic trip switch 12 to open. This provides a current path around contacts 52, before contacts 52 begin to open, so that when contacts 52 begin to open, the switch Q1 remains on and continues to provide a current path around contacts 52 for a sufficient time, after contacts 52 begin to open, to prevent an arc from becoming established.

For manual operation, switch-control circuit 40 is adapted to receive control signals from microprocessor 19, and to transmit corresponding control signals to arc suppression circuit 20 to turn switch Q1 on before microprocessor 19 commands contacts 51 of automatic trip switch 11 to open.

A first preferred mode of use of the second embodiment requires that the microprocessor turns on switch Q1 just before the microprocessor initiates a trip operation. This applies to both manual and automatic modes. This technique reduces the heat load on switch Q1. Alternatively, a second mode of use requires that switch Q1 be continuously on when AC circuit breaker contacts 17 are closed.

Figure 6:
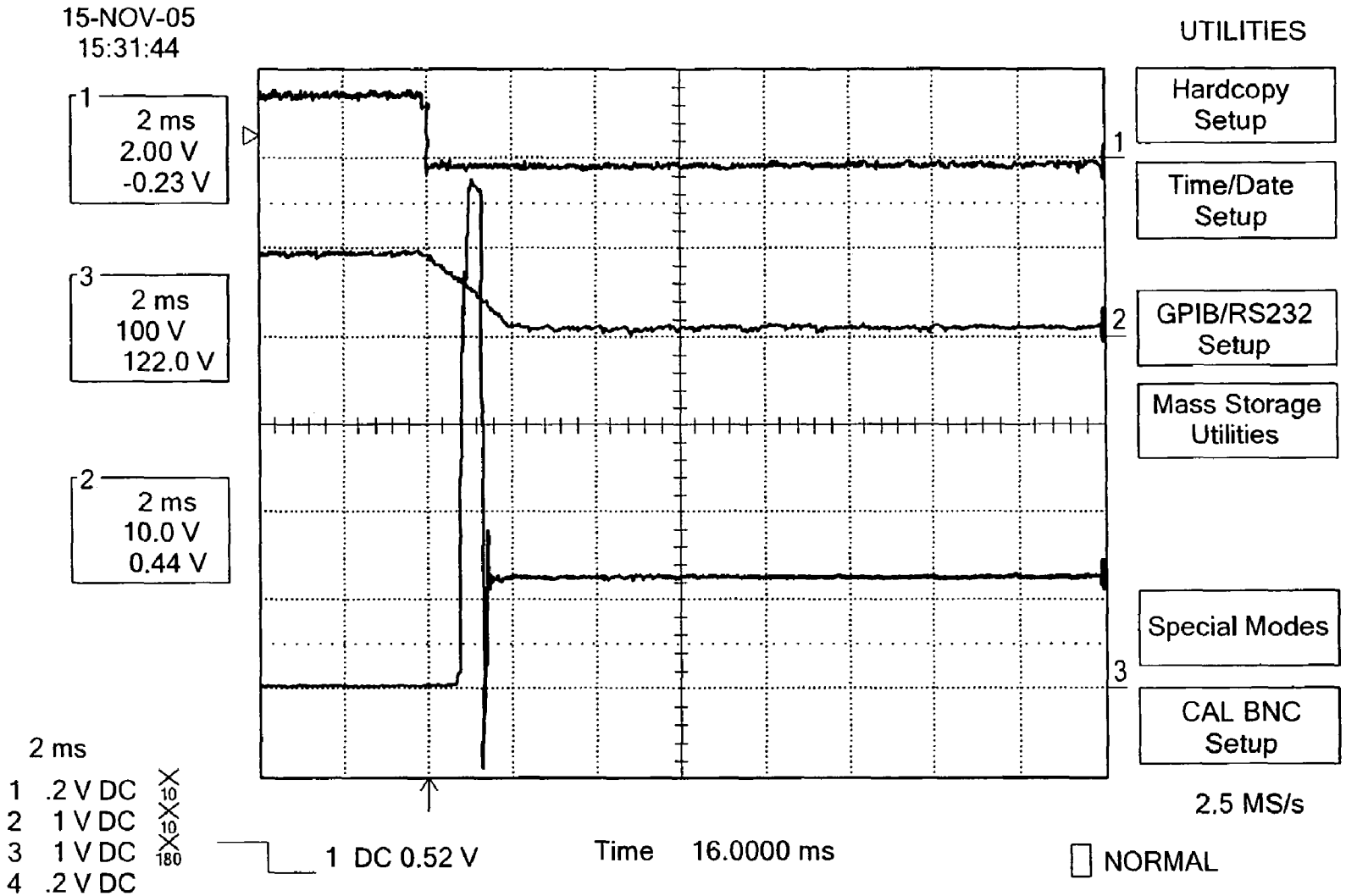
FIG. 6 is an oscilloscope trace showing a simulated transient electrical voltage associated with the second embodiment and a first circuit breaker coil.
Figure 7:
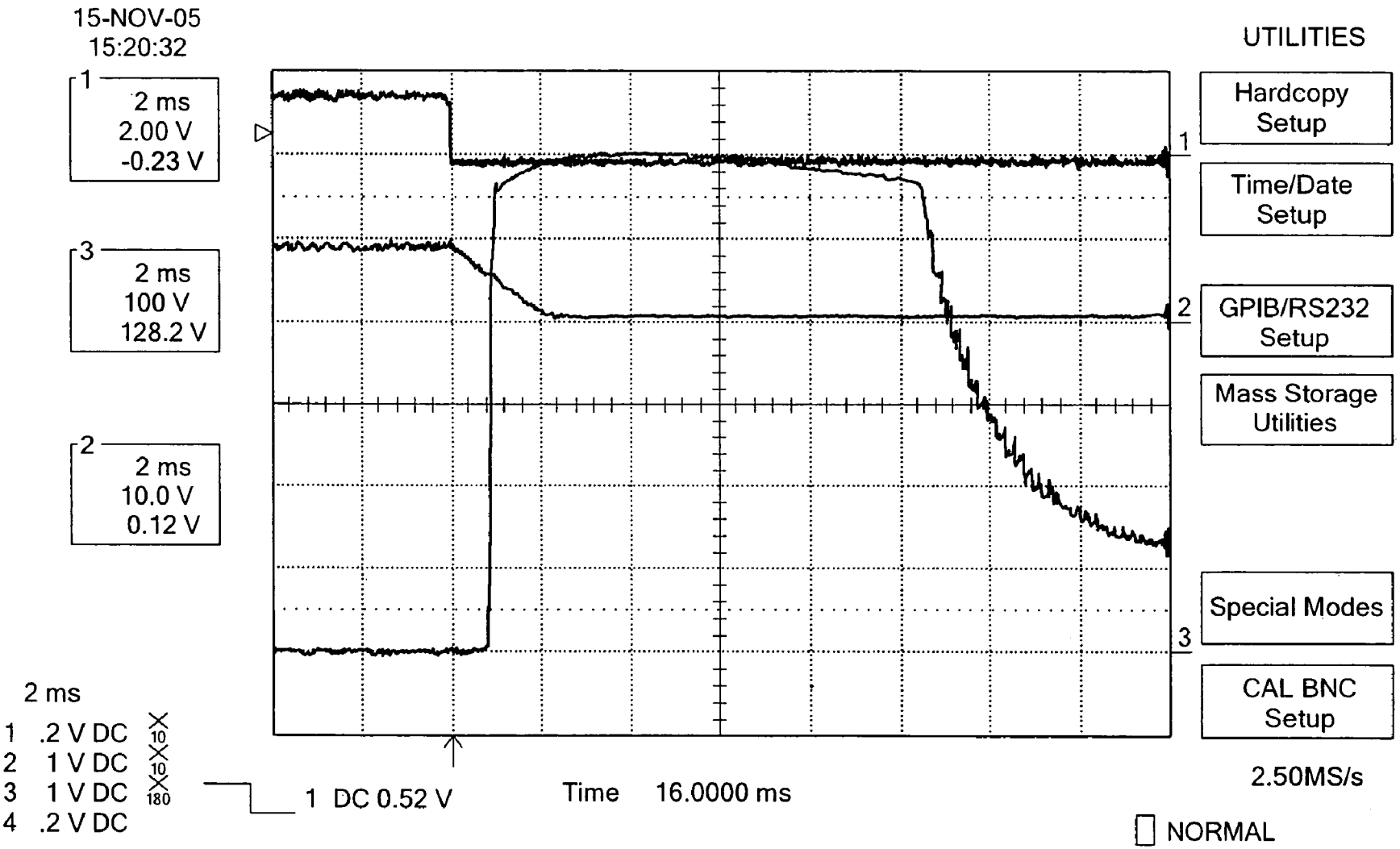
FIG. 7 is an oscilloscope trace showing a simulated transient electrical voltage associated with the second embodiment and a second circuit breaker coil.

FIG. 6 is an oscilloscope trace showing a simulated transient electrical voltage associated with the second embodiment and a first circuit breaker coil. FIG. 7 is an oscilloscope trace showing a simulated transient electrical voltage associated with the second embodiment and a second circuit breaker coil.

What is claimed is:

1. An arc suppression circuit for suppression of arcing across trip contacts coupled to operate a battery-powered solenoid, the battery-powered solenoid including a battery and a solenoid, the circuit comprising:

a semi-conductor switch connected across the battery-powered solenoid; and a switch-control circuit controlling the semi-conductor switch;

wherein the switch-control circuit is configured such that while the contacts are closed, the semi-conductor switch is on, providing a current path around the contacts, and when the contacts begin to open, the semi-conductor switch remains on and continues to provide the current path around the contacts for a sufficient time after the contacts begin to open to prevent an arc from becoming established, wherein the semiconductor switch carries substantially all of the current flowing through the battery-powered solenoid when providing the current path around the contacts when the contacts are closed and when the contacts begin to open.

2. An arc suppression circuit according to claim 1, wherein after the contacts begin to open, the current path around the contacts is maintained for a predefined time that is determined by the time constant of a resistance and a capacitance.

3. An arc suppression circuit according to claim 2, wherein the semi-conductor switch is a power transistor having a gate, and wherein the switch-control circuit includes:

a capacitor connected in series with the contacts and the battery-powered solenoid; and a voltage divider connected across the capacitor, the voltage divider having an output coupled to the gate.

4. An arc suppression circuit according to claim 3, wherein the power transistor is an insulated gate bipolar junction transistor (IGBT).

5. An arc suppression circuit according to claim 3, further comprising a clamping diode coupled to the gate, whereby the power transistor is protected from overvoltage applied at its gate.

6. An arc suppression circuit according to claim 3, further comprising a metal oxide varistor connected across the semi-conductor switch, whereby the power transistor is protected from overvoltage damage.

7. An arc suppression circuit according to claim 3, further comprising a diode connected in series with the semi-conductor switch and the battery-powered solenoid, whereby the power transistor is protected from reverse polarity damage.

8. A method for suppression of arcing across trip contacts used to turn off a battery-powered solenoid and trip an AC power circuit breaker, the method comprising:

providing a semi-conductor switch connected across the contacts;

turning the switch on to provide a current path around the contacts before the contacts are opened;

holding the switch on while the contacts continue to open;

turning the switch off after a sufficient time has elapsed to prevent an arc from becoming established;

providing a capacitor connected to a resistance;

closing the trip contacts;

after closing the trip contacts, charging the capacitor; and wherein the step of turning the switch on is performed a predetermined amount of time after the closing of the trip contacts; and wherein the predetermined amount of time is determined by the capacitor and the resistance.

9. The method of claim 8, wherein the current path around the contacts carries substantially all of the current flowing through the battery-powered solenoid.

* * * * *

UNITED STATES PATENT AND TRADEMARK OFFICE

CERTIFICATE OF CORRECTION

PATENT NO. : 7,697,247 B2
APPLICATION NO. : 11/598240
DATED : April 13, 2010
INVENTOR(S) : Mohamed Maharsi et al.

It is certified that error appears in the above-identified patent and that said Letters Patent is hereby corrected as shown below:

Title page, item [75] inventors should read as follows:
Mark C. Giacobbe
Deia Salah-Eldin Bayoumi Signed and Sealed this First Day of June, 2010

David J. Kappos

David J. Kappos
*Director of the United States Patent and Trademark Office*